US011497376B2

(12) United States Patent
Klaiber et al.

(10) Patent No.: US 11,497,376 B2
(45) Date of Patent: Nov. 15, 2022

(54) WASHING CONTAINER AND DOMESTIC DISHWASHER

(71) Applicant: BSH Hausgeräte GmbH, Munich (DE)

(72) Inventors: Armin Klaiber, Günzburg (DE); Andrzej Budzynski, Augsburg (DE); Johann Schabert, Holzheim (DE); Dieter Hotz, Dischingen (DE)

(73) Assignee: BSH Hausgeräte GmbH, Munich (DE)

( * ) Notice: Subject to any disclaimer, the term of this patent is extended or adjusted under 35 U.S.C. 154(b) by 265 days.

(21) Appl. No.: 16/616,994

(22) PCT Filed: May 24, 2018

(86) PCT No.: PCT/EP2018/063620
§ 371 (c)(1),
(2) Date: Nov. 26, 2019

(87) PCT Pub. No.: WO2018/224322
PCT Pub. Date: Dec. 13, 2018

(65) Prior Publication Data

US 2021/0121040 A1 Apr. 29, 2021

(30) Foreign Application Priority Data

Jun. 9, 2017 (DE) ..... 10 2017 209 826.0

(51) Int. Cl.
*A47L 15/42* (2006.01)

(52) U.S. Cl.
CPC ..... *A47L 15/4246* (2013.01); *A47L 15/4261* (2013.01); *A47L 15/4272* (2013.01); *A47L 15/4263* (2013.01)

(58) Field of Classification Search
CPC ..... A47L 15/4246; A47L 15/4241; A47L 15/4272; A47L 15/4263; A47L 15/4261
See application file for complete search history.

(56) References Cited

U.S. PATENT DOCUMENTS

2010/0192990 A1* 8/2010 Hotz ..... A47L 15/4246 134/115 R
2011/0018409 A1 1/2011 Fetzer et al.
(Continued)

FOREIGN PATENT DOCUMENTS

| | | | |
|---|---|---|---|
| CN | 106466169 | A | 3/2017 |
| DE | 102013216057 | B3 | 12/2014 |
| EP | 2420177 | A2 | 2/2012 |

OTHER PUBLICATIONS

Machine English translation of Description of DE 102013216057 B3 (Becker) (Year: 2014).*
(Continued)

*Primary Examiner* — Joseph L. Perrin
*Assistant Examiner* — Irina Graf
(74) *Attorney, Agent, or Firm* — Michael E. Tschupp; Andre Pallapies; Brandon G. Braun

(57) ABSTRACT

A dishwasher cavity for a household dishwasher includes a U-shaped dishwasher cavity casing, a U-shaped frame connected to the dishwasher cavity casing and supporting the dishwasher cavity casing, and a hinge plate provided on the frame. The frame includes a receiving portion. The hinge plate includes a depth positioning portion, which is received in a form-fit manner in the receiving portion of the frame to fix the hinge plate to the frame in a depth direction of the dishwasher cavity.

12 Claims, 5 Drawing Sheets

(56) References Cited

U.S. PATENT DOCUMENTS

| | | | |
|---|---|---|---|
| 2011/0085298 | A1 | 4/2011 | Xiao |
| 2012/0138108 | A1 | 6/2012 | Astiz Montoya |
| 2012/0153786 | A1 | 6/2012 | Kuecuek et al. |

OTHER PUBLICATIONS

International Search Report PCT/Ep2018/063620 dated Aug. 22, 2018.
National Search Report CN 2018800379546 dated Mar. 8, 2022.

* cited by examiner

WASHING CONTAINER AND DOMESTIC DISHWASHER

CROSS-REFERENCES TO RELATED APPLICATIONS

This application is the U.S. National Stage of International Application No. PCT/EP2018/063620, filed May 24, 2018, which designated the United States and has been published as International Publication No. WO 2018/224322 A1 and which claims the priority of German Patent Application, Serial No. 10 2017 209 826.0, filed Jun. 9, 2017, pursuant to 35 U.S.C. 119(a)-(d).

BACKGROUND OF THE INVENTION

The present invention relates to a dishwasher cavity for a household dishwasher and a household dishwasher with a dishwasher cavity of this type.

In most cases a dishwasher has a dishwasher cavity which is formed from several sheet metal portions which are connected to one another. The dishwasher cavity can be reinforced with the aid of a frame fastened hereto. A door which is pivotably mounted on the dishwasher cavity with the aid of plate hinges which are fastened to the frame can be provided to open and close the dishwasher cavity.

The publication DE 10 2010 063 447 A1 discloses a dishwasher with a dishwasher cavity, the front-side loading opening of which is surrounded by a base-side open front frame, which rests against bearing elements of a base-side base carrier with its side frame strips. Each of the side frame strips of the front frame has a hook element which surrounds the bearing element of the base carrier.

The publication DE 10 2013 216 057 B3 discloses a dishwasher with a frame part, which has a counter bracket and a rear-engaging element which projects herefrom, and a hinge plate, which supports the frame part in the vertical direction, wherein the rear-engaging element engages behind the hinge plate such that it rests against the counter bracket by way of at least one point above and by way of at least one point below the rear-engaging element.

BRIEF SUMMARY OF THE INVENTION

Against this background, an object of the present invention consists in providing an improved dishwasher cavity for a household dishwasher.

Accordingly, a dishwasher cavity for a household dishwasher is proposed. The dishwasher cavity comprises a U-shaped dishwasher cavity casing, a U-shaped frame connected to the dishwasher cavity casing, which supports the dishwasher cavity casing and at least one hinge plate provided on the frame, wherein the frame has a receiving portion and the at least one hinge plate has a depth positioning portion, which is received in a form-fit manner in the receiving portion in order to fix the at least one hinge plate to the frame in a depth direction of the dishwasher cavity.

As a result of the depth positioning portion being received in a form-fit manner in the receiving portion, a fixing in the depth direction can reliably be ensured in that the depth positioning portion cannot be moved in the depth direction relative to the receiving portion. In this way a fixed bearing can be realized on the frame, as a result of which high forces, for instance during operation of a household dishwasher with a dishwasher cavity of this type, during the storing or transportation of the same, can be received.

A form-fit connection is produced by means of the interlocking and rear-engagement of at least two connecting partners, in this case the depth positioning portion and the receiving portion. The depth direction is oriented from a loading opening of the dishwasher cavity in the direction of a rear wall of the same or vice versa. The dishwasher cavity further comprises a width direction, which is oriented from a first side wall of the dishwasher cavity casing in the direction of a second side wall of the same or vice versa. Furthermore, the dishwasher cavity has a height direction which is oriented from a bottom panel of the dishwasher cavity in the direction of a ceiling of the dishwasher cavity casing or vice versa. Here the width direction, the depth direction and the height direction are positioned at right angles to one another.

The frame is preferably a plastic component, in particular a plastic injection-molded component, which is fixedly connected to the dishwasher cavity casing with the aid of a hot riveting method. The hinge plate is preferably a metal component. The hinge plate can also be received at least in sections in a base carrier arranged below the dishwasher cavity or can rest hereupon. The base carrier is preferably embodied in the shape of a box and arranged below the bottom panel of the dishwasher cavity.

According to one embodiment, first introducer sheaths are provided on the receiving portion which are designed to introduce the depth positioning portion into the receiving portion.

The receiving portion can have the first introducer sheaths. In addition to the first introducer sheaths, the receiving portion has two further side surfaces arranged parallel to one another and an end face. The depth positioning portion likewise has two corresponding side surfaces which are arranged parallel to one another which, when the depth positioning portion is received in the receiving portion, can rest against the side surfaces of the receiving portion. The depth positioning portion further has an end face which is arranged opposite a base of the receiving portion. Here the end face of the depth positioning portion nevertheless does not rest on the bottom of the receiving portion. In other words, the depth positioning portion and the receiving portion make it possible preferably only to fix the hinge plate in the depth direction and not in the height direction.

According to a further embodiment, second introducer sheaths are provided on the depth positioning portion corresponding to the first introducer sheaths.

The depth positioning portion can comprise the second introducer sheaths. Aside from the second introducer sheaths, the depth positioning portion, as mentioned previously, comprises the end face and the two side surfaces which are arranged parallel to one another, which, when the depth positioning portion is introduced into the receiving portion, slide along the side surfaces of the receiving portion. Provision is preferably made for play of at most 0.3 mm in the depth direction between the side surfaces of the depth positioning portion and the side surfaces of the receiving portion.

According to a further embodiment, the first introducer sheaths and/or the second introducer sheaths are arranged in the shape of a roof.

In other words, the first introducer sheaths and/or the second introducer sheaths are each inclined in opposing pairs.

According to a further embodiment, the at least one hinge plate has a height positioning portion which is designed to fix the at least one hinge plate to the frame in a height direction of the dishwasher cavity.

The height positioning portion is preferably embodied as a notched recess which is arched at right angles outward from a base portion of the hinge plate. As a result, the height positioning portion can be produced in one piece with the base portion. As a result, a particularly cost-effective manufacture of the hinge plate is possible.

According to a further embodiment, the frame has a contact portion on which the height positioning portion rests for fixing the at least one hinge plate in the height direction.

With the aid of the contact portion and the height positioning portion, it is however preferably not possible to fix the hinge plate in the depth direction of the dishwasher cavity. In other words, the fixing in the depth direction is carried out separately from the fixing in the height direction. The frame can have a positioning slot between the contact portion and the receiving portion, into which the hinge plate is inserted. The positioning slot is used to fix the hinge plate in the width direction of the dishwasher cavity.

According to a further embodiment, the dishwasher cavity comprises a door, which is mounted pivotably on the at least one hinge plate.

The hinge plate comprises a pivot axis, about which the door can be pivoted, in order to open and close the dishwasher cavity.

According to a further embodiment, the frame comprises a first limb, which is connected to a first side wall of the dishwasher cavity casing, and a second limb, which is connected to a second side wall of the dishwasher cavity, wherein a hinge plate is provided on each limb.

An intermediate limb which connects the first limb with the second limb is provided in particular between the first limb and the second limb. The intermediate limb is preferably fixedly connected to a ceiling of the dishwasher cavity casing. In particular, the frame is hot riveted to the dishwasher cavity casing.

According to a further embodiment, the dishwasher cavity comprises a bottom panel, on which the dishwasher cavity casing is arranged and with which the dishwasher cavity casing is fixedly connected, and a rear wall, which is fixedly connected to the dishwasher cavity casing and the bottom panel and which closes the dishwasher cavity in the depth direction on the rear side.

The dishwasher cavity casing is preferably arranged on the base plate so that this is upwardly closed and downwardly open. In other words, the dishwasher cavity casing is arranged vertically on the base plate. The dishwasher container is connected to the base plate with the aid of folded joints, for instance. The rear wall is fastened to a fastening flange which encircles the dishwasher cavity casing and the base plate. The rear wall is preferably welded, in particular spot-welded, to the dishwasher cavity casing and the base plate.

Furthermore, a household dishwasher with a dishwasher cavity of this type is proposed.

The door which can be pivoted about the pivot axis in order to open and close the dishwasher cavity is attached to the dishwasher cavity. A plurality of receptacles, for instance three, for items to be washed arranged one above the other can be provided in the dishwasher cavity.

Further possible implementations of the dishwasher cavity and/or of the household dishwasher also comprise combinations—not explicitly cited—of features or embodiments described above or below in respect of the exemplary embodiments. In such cases the person skilled in the art will also add individual aspects as improvements or amendments to the respective basic form of the dishwasher cavity and/or of the household dishwasher.

BRIEF DESCRIPTION OF THE DRAWINGS

Further advantageous embodiments and aspects of the dishwasher cavity and/or of the household dishwasher form the subject matter of the subclaims and the exemplary embodiments of the dishwasher cavity and/or of the household dishwasher described below. The dishwasher cavity and/or the household dishwasher are further explained in greater detail below on the basis of the preferred embodiments with reference to the appended figures, in which:

DETAILED DESCRIPTION OF EXEMPLARY EMBODIMENTS OF THE PRESENT INVENTION

Figure 1:
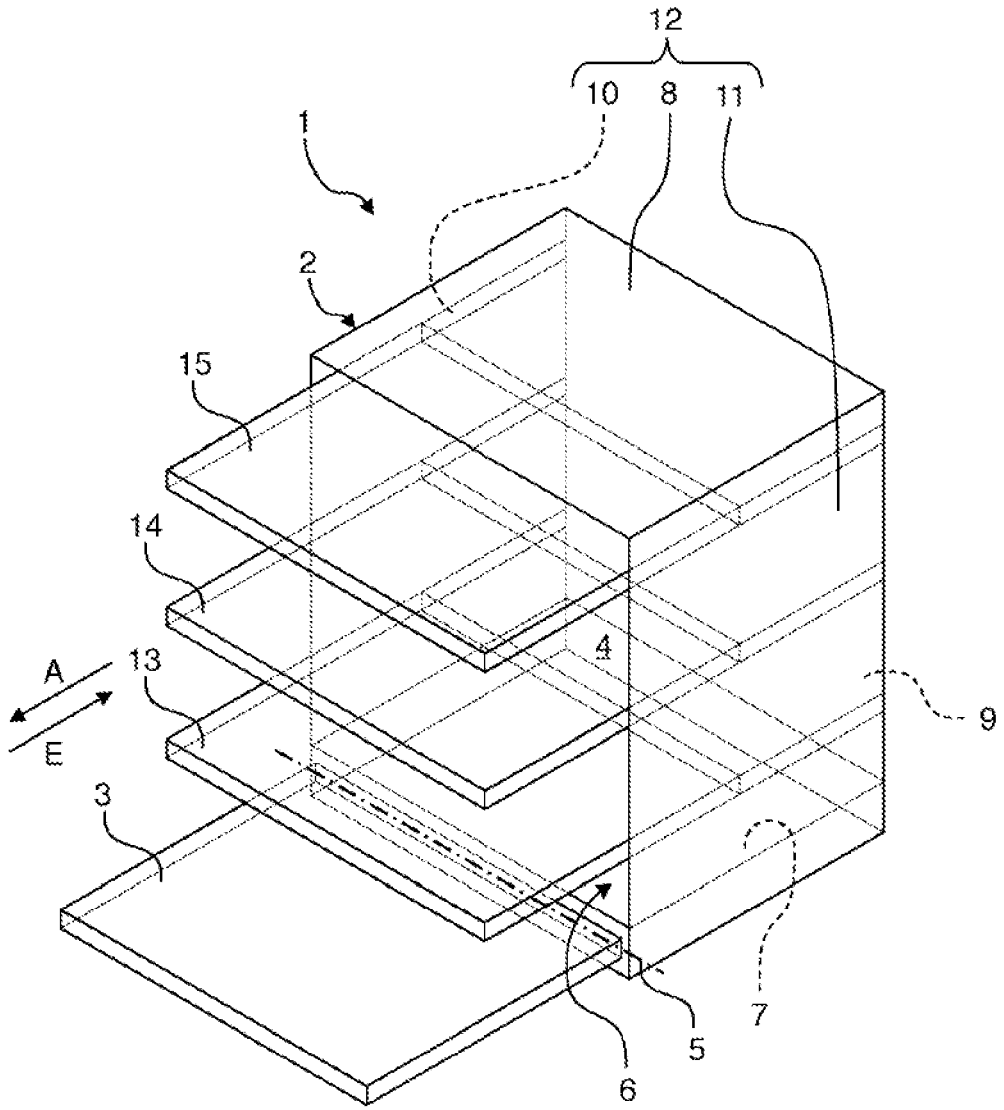
FIG. 1 shows a schematic perspective view of an embodiment of a household dishwasher.

In the figures, elements that are identical or have the same function are provided with the same reference characters unless otherwise stated.

FIG. 1 shows a schematic perspective view of a household dishwasher 1. The household dishwasher 1 comprises a dishwasher cavity 2, which can be closed by a door 3, in particular in a watertight manner. To this end, a sealing facility can be provided between the door 3 and the dishwasher cavity 2. The dishwasher cavity 2 is preferably cuboid in shape. The dishwasher cavity 2 can be arranged in a housing of the household dishwasher 1. The dishwasher cavity 2 and the door 3 can form a dishwasher interior 4 for washing items to be washed.

The door 3 is shown in its opened position in FIG. 1. The door 3 can be closed or opened by pivoting about a pivot axis 5 provided on a lower end of the door 3. A loading opening 6 of the dishwasher container 2 can be closed or opened with the aid of the door 3. The dishwasher cavity 2 has a bottom panel 7, a ceiling 8 arranged opposite the bottom panel 7, a rear wall 9 arranged opposite the closed door 3 and two side walls 10, 11 arranged opposite one another. The bottom panel 7, the ceiling 8, the rear wall 9 and the side walls 10, 11 can be manufactured from a sheet steel, for instance. In particular, the bottom panel 7 can be manufactured from a different material to that of the ceiling 8 and the side walls 10, 11, for instance. For instance, the bottom panel 7 can be manufactured from the material 1.4301, the ceiling 8 and the side walls 10, 11 from the material 1.4016 and the rear wall 9 likewise from the material 1.4016.

A first side wall 10, a second side wall 11 and the ceiling 8 arranged between the first side wall 10 and the second side wall 11 are embodied in one-piece, in particular from a single piece of material, and form a dishwasher cavity casing 12 of the dishwasher cavity 2. The dishwasher cavity casing 12, the rear wall 9 and the bottom panel 7 are components manufactured separately from one another, which are connected to one another in a watertight manner, however. For instance, the dishwasher cavity casing 12 is connected to the bottom panel 7 with the aid of a folded joint, and the rear wall 9 is welded, in particular spot-welded, to the dishwasher cavity casing 12 and to the bottom panel 7.

The household dishwasher 1 also has at least one receptacle 13 to 15 for items to be washed. A number of, for instance three, receptacles 13 to 15 for items to be washed can preferably be provided, wherein the receptacle 13 for items to be washed can be a lower receptacle for items to be washed or a bottom basked, the receptacle 14 for items to be washed can be an upper receptacle for items to be washed or an upper basket and the receptacle 15 for items to be washed can be a cutlery drawer. As also shown in FIG. 1, the receptacles 13 to 15 for items to be washed are arranged one above the other in the dishwasher cavity 2. Each receptacle 13 to 15 for items to be washed can optionally be moved in or out of the dishwasher cavity 2. In particular, each receptacle 13 to 15 for items to be washed can be slid in an insertion direction E (arrow) into the dishwasher container 2 and against the insertion direction E (arrow) in a pull-out direction A (arrow) out of the dishwasher cavity 2.

Figure 2:
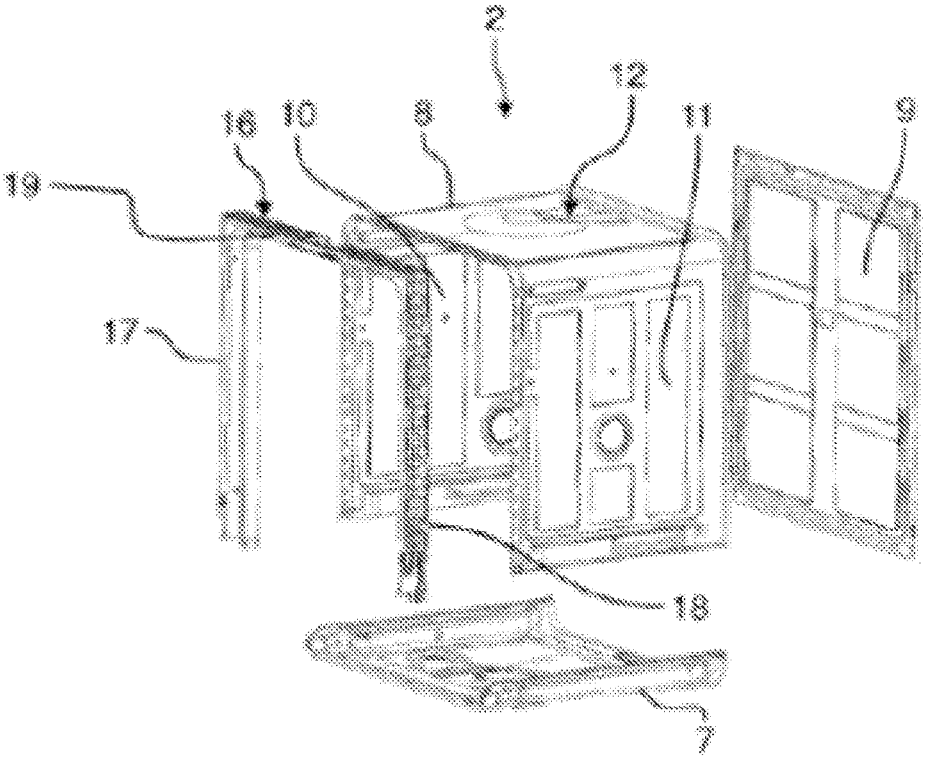
FIG. 2 shows a schematic perspective exploded view of an embodiment of a dishwasher for the household dishwasher according to FIG. 1.
Figure 3:
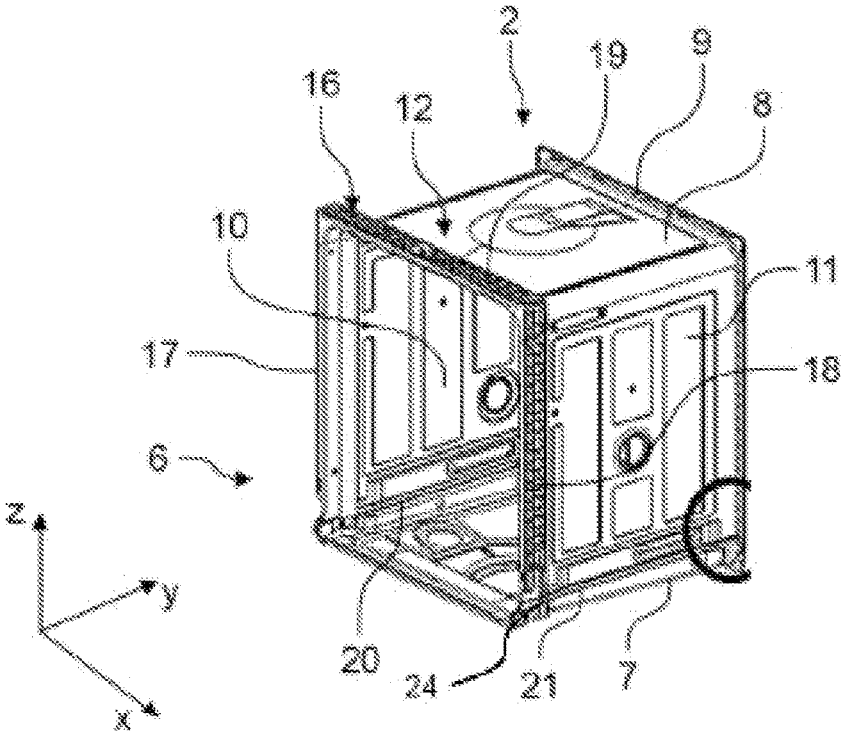
FIG. 3 shows a schematic perspective view of the dishwasher cavity according to FIG. 2.

FIG. 2 shows a schematic perspective exploded view of an embodiment of the dishwasher cavity 2 for the household dishwasher 1 according to FIG. 1. FIG. 3 shows a schematic perspective view of the dishwasher cavity 2 according to FIG. 2. Reference is made below simultaneously to FIGS. 2 and 3.

The dishwasher cavity 2 comprises, in addition to the U-shaped dishwasher cavity casing 12, the bottom panel 7 and the rear wall 9, a U-shaped frame 16 which supports the dishwasher cavity casing 12. To this end the frame 16 is fixedly connected to the dishwasher cavity casing 12. In particular, the frame 16 is connected to the dishwasher cavity casing 12 with the aid of hot riveting. The frame 16 is a plastic component. In particular, the frame 16 is a plastic injection-molded component. In this way the frame 16 can be cost-effectively manufactured in large quantities.

The frame 16 is embodied so that it is provided on the loading opening 6, and is arranged at least in sections within the dishwasher cavity casing 12 and at least in sections outside of the dishwasher cavity casing 12. The dishwasher cavity 2 further comprises a base carrier, not shown in FIGS. 2 and 3, which is arranged below the bottom panel 7. In particular, the dishwasher cavity 2 rests on the base carrier. The base carrier is a plastic component, in particular a plastic injection-molded component.

As shown in FIG. 3, the frame 16 is slid onto the loading opening 6 on the front side and thus reinforces the dishwasher cavity casing 12 in the region of the loading opening 6. The frame 16 comprises a first limb 17, a second limb 18 and an intermediate limb 19, which connects the first limb 17 to the second limb 18. The first limb 17 is fixedly connected to the first side wall 10, the second limb 18 is fixedly connected to the second side wall 11 and the intermediate limb 19 is fixedly connected to the ceiling 8.

The first side wall 10 can be connected to the bottom panel 7 with the aid of a first flare joint or first folded joint 20 and the second side wall 11 can likewise be connected to the bottom panel 7 with the aid of a second flare joint or second folded joint 21. Folding or flaring is to be understood here to mean a connection technique in sheet metal forming. This connection technique is one of the 'joining by forming' group. Here, an edge of a sheet metal is bent with the aid of a flaring machine or folding machine. In this way the bent edge is reinforced and a connection from several sheet metal components can be produced. The folded joints 20, 21 extend in each case across an entire depth of the dishwasher cavity 2, in other words from the loading opening 6 as far as the rear wall 9. The dishwasher cavity 2 further comprises an x-direction or width direction x, a y-direction or depth direction y (arrow) and a z-direction or height direction x. The folded joints 20, 21 extend in the depth direction y.

Figure 4:
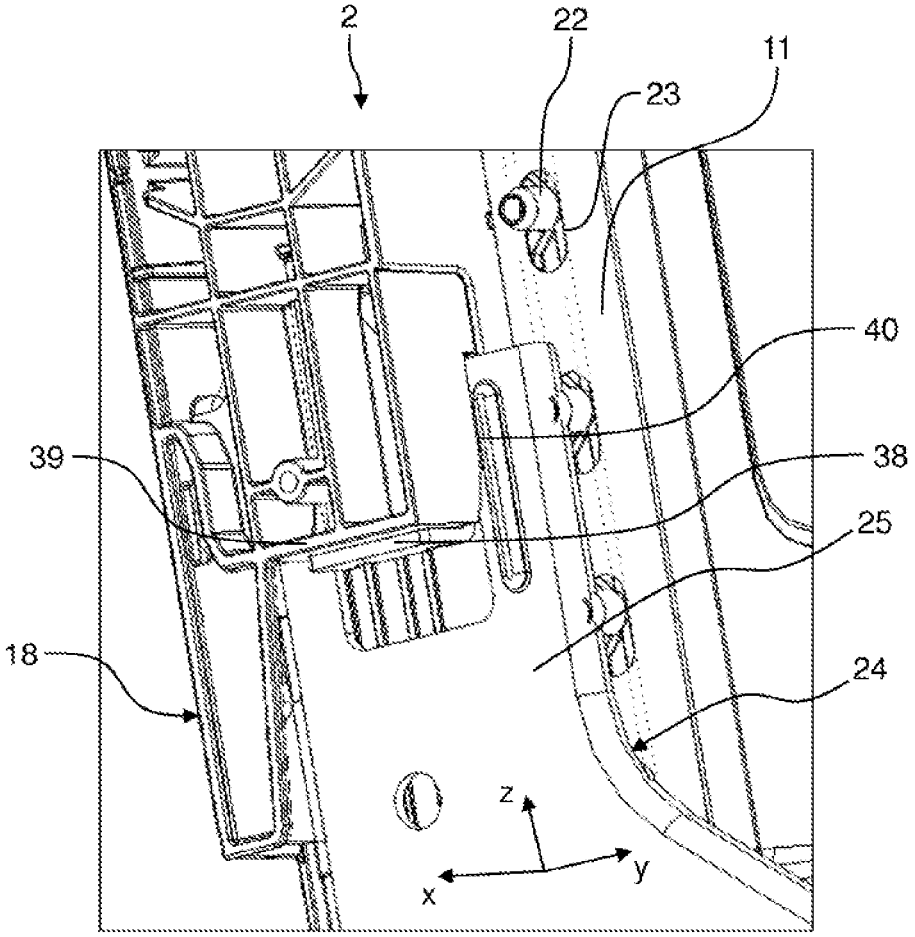
FIG. 4 shows a schematic perspective detailed view of the dishwasher cavity according to FIG. 2.
Figure 5:
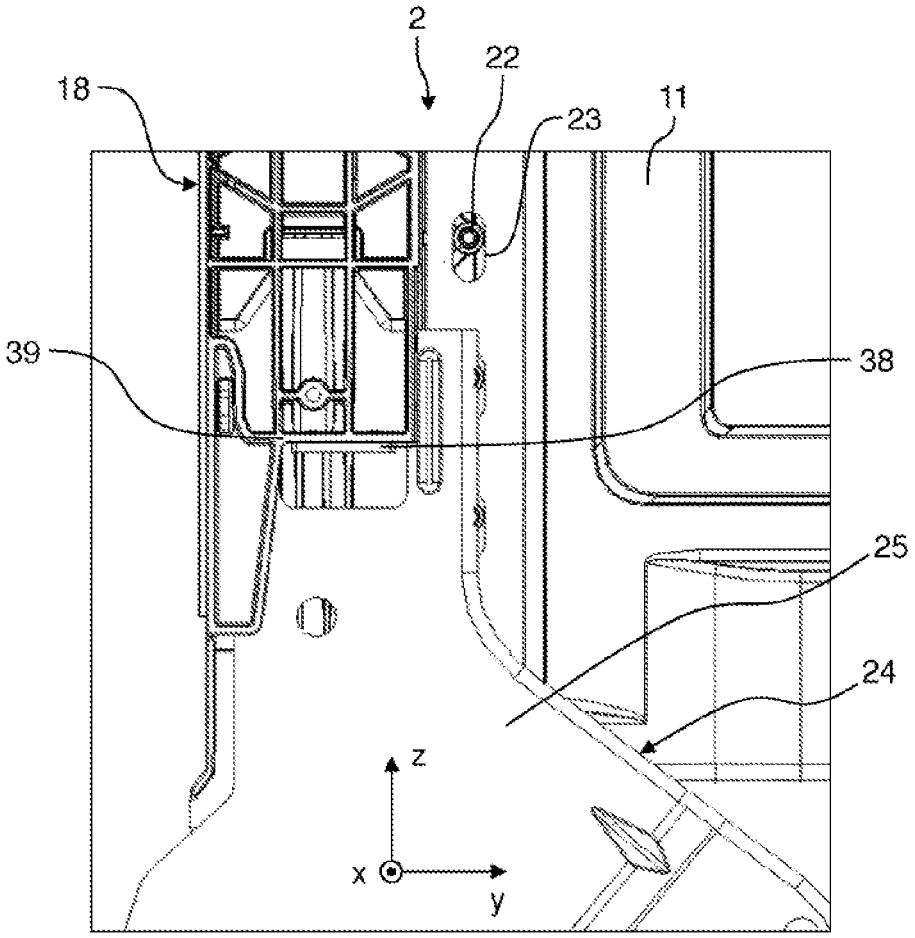
FIG. 5 shows a schematic detailed view of the dishwasher cavity according to FIG. 2.
Figure 6:
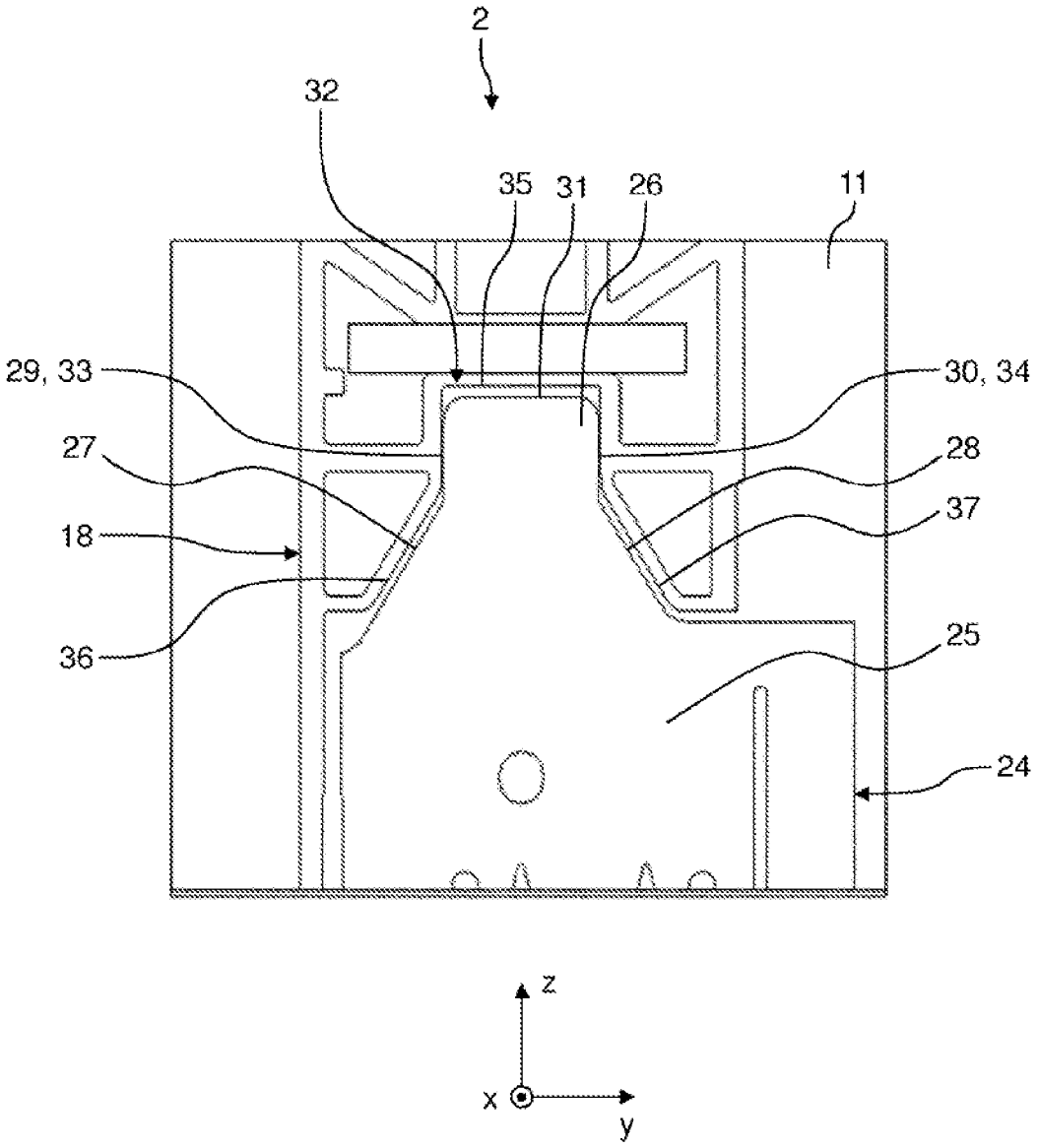
FIG. 6 shows a further schematic detailed view of the dishwasher cavity according to FIG. 2.

FIGS. 4 to 6 show different detailed views of the dishwasher cavity 2 with a viewing direction from outside onto the second side wall 11 and the second limb 18 of the frame 16. The frame 16 comprises a plurality of hot rivets 22, which are guided through cutouts 23 provided in the dishwasher cavity casing 12. The hot rivets 22 are guided through the cutouts 23, melted on and flat printed in order to fasten the frame 16 to the dishwasher cavity casing 12. In this way the frame 16 can be fixedly fastened to the dishwasher cavity casing 12.

Two hinge plates 24 are provided on the frame 16. The hinge plates 24 are manufactured from a steel material, for instance. For instance, the hinge plates 24 are sheet metal stamped/bent components. A hinge plate 24 of this type is assigned to each of the limbs 17, 18. The door 3 can be pivotably mounted on the dishwasher cavity 2 with the aid of the hinge plates 24, and pivoted about the pivot axis 5 in order to open and close the dishwasher cavity 2. The hinge plates 24 can be mounted in the base carrier mentioned previously. However, reference is made below to just one hinge plate 24.

The hinge plate 24 comprises a plate-shaped base portion 25, on which, on the top side, in other words facing the respective limb 17, 18 of the frame 16, a depth positioning portion 26 (FIG. 6) is provided. The depth positioning portion 26 is assigned two introducer sheaths 27, 28, which are arranged in the shape of a roof. The base portion 25 tapers across the introducer sheaths 27, 28 toward the depth positioning portion 26. The depth positioning portion 26 has two side surfaces 29, 30 arranged in parallel to one another, and one end face 31.

The frame 16, in other words, each of the limbs 17, 18, comprises a receiving portion 32 which corresponds to the depth positioning portion 26. The receiving portion 32 comprises two side surfaces 33, 34 corresponding to the side surfaces 29, 30, and a bottom 35, which faces the end face 31 of the depth positioning portion 26. Two introducer sheaths 36, 37 arranged in the shape of a roof are also assigned to the receiving portion 32. The introducer sheaths 36, 37 can be referred to as first introducer sheaths and the introducer sheaths 27, 28 can be referred to as second introducer sheaths.

With the aid of the depth positioning portion 26 and the corresponding receiving portion 32, the hinge plate 24 is fixed to the frame 16 and in particular to the limbs 17, 18 in the depth direction y (arrow) of the dishwasher cavity 2. To this end, the depth positioning portion 26 is received in a form-fit manner in the receiving portion 32. A form-fit connection is produced by means of the interlocking or rear-engagement of at least two connecting partners, in this case the depth positioning portion 26 and the receiving portion 32. The form-fit connection then acts in the depth direction y; in other words, when the depth positioning portion 26 is received in the receiving portion 32, the depth positioning portion 26 cannot be moved in the depth direction y (arrow) relative to the frame 16.

In order to assemble the hinge plate 24 on the frame 16, the depth positioning portion 26 is inserted in the height direction x (arrow) into the receiving portion 32. In this way the introducer sheaths 27, 28, 36, 37 enable a simple introduction of the depth positioning portion 26 into the receiving portion 32. If the depth positioning portion 26 is received in the receiving portion 32, the side surfaces 29, 30 of the depth positioning portion 26 rest on the corresponding side surfaces 33, 34 of the receiving portion 32. In this case, play between the side surfaces 29, 30 and 33, 44 can amount to a few tenths of a millimeter, for instance 0.3 mm.

The end face 31 of the depth positioning portion 26 is however arranged at a distance from the bottom 35 of the receiving portion 32. In other words, a positioning in the height direction x (arrow) is not carried out with the aid of the depth positioning portion 26 and the receiving portion 32. In particular, there is no form-fit connection between the depth positioning portion 26 and the receiving portion 32 in the height direction z (arrow). The depth positioning portion 26 and the receiving portion 32 thus form a fixed bearing only in the depth direction y (arrow).

As FIGS. 4 and 5 show, the hinge plate 24 also comprises a height positioning portion 38, which is embodied for instance as a notched recess bent out at right angles from the base portion 25. The hinge plate 24 can be fixed to the frame 16 in the height direction z (arrow) with the aid of the height positioning portion 38. To this end, the frame 16 has a contact portion 39 on each limb 17, 18, on which the height positioning portion 38 rests in order to fix the hinge plate 24 in the height direction z (arrow). The contact portion 39 is not shown in FIG. 6 for the sake of clarity.

A reliable fixing of the hinge plate 24 both in the depth direction y (arrow) and also in the height direction z (arrow) is possible with the aid of the depth positioning portion 26 and the height positioning portion 38. A fixing of the hinge plate 24 in the width direction x (arrow) is ensured in that the hinge plate 24 is inserted into a positioning slot 40 provided between the height positioning portion 38 and the receiving portion 32.

With the aid of the depth positioning portion 26, the receiving portion 32, the height positioning portion 38, the contact portion 39 and the positioning slot 40, precise positioning between the dishwasher cavity 2 and the hinge plates 24 is possible both in the depth direction y, the height direction z (arrow) and also the width direction x (arrow). In particular, precise positioning of the hinge plate 24 is possible in the height direction z (arrow). The form-fit connection between the depth positioning portion 26 and the receiving portion 32 enables the transmission of heavy loads, for instance when transporting, storing or installing the household dishwasher 1. The end position of the dishwasher cavity 2 with respect to the hinge plate 24 can be checked visually by means of installation personnel or automatically, for example with the aid of a camera.

Although the present invention has been described on the basis of exemplary embodiments, it can be modified in a variety of ways.

REFERENCE CHARACTERS USED

1 household dishwasher
2 dishwasher cavity
3 door
4 dishwasher interior
5 pivot axis
6 loading opening
7 bottom panel
8 ceiling
9 rear wall
10 side wall
11 side wall
12 dishwasher cavity casing
13 receptacle for items to be washed
14 receptacle for items to be washed
15 receptacle for items to be washed
15 frame
17 limb
18 limb
19 intermediate limb
20 folded joint
21 folded joint
22 hot rivet
23 cutout
24 hinge plate
25 base portion
26 depth positioning portion
27 introducer sheath
28 introducer sheath
29 side surface
30 side surface
31 end face
32 receiving portion
33 side surface
34 side surface
35 bottom
36 introducer sheath
37 introducer sheath
28 height positioning portion
39 contact portion
40 positioning slot
A pull-out direction (arrow)
E insertion direction (arrow)
x width direction (arrow)
y depth direction (arrow)
z height direction (arrow)

The invention claimed is:

1. A dishwasher cavity for a household dishwasher, comprising:

a U-shaped dishwasher cavity casing;

a U-shaped frame connected to the dishwasher cavity casing and supporting the dishwasher cavity casing, said frame including a receiving portion that comprises:

a first side;

a second side positioned opposite the first side;

a third side connecting a first end of the first side to a first end of the second side; and a first introducer sheath configured to introduce a depth positioning portion into the receiving portion, the first introducer sheath comprising:

a first tapered side connected to a second end of the first side; and a second tapered side opposite the first tapered side and connected to a second end of the second side; and a hinge plate including the depth positioning portion that comprises:

a fourth side corresponding to the first side;

a fifth side corresponding to the second side and positioned opposite the fourth side;

a sixth side corresponding to the third side and connecting a first end of the fourth side to a first end of the fifth side; and a second introducer sheath corresponding to the first introducer sheath, the second introducer sheath comprising:

a third tapered side corresponding to the first tapered side and connected to a second end of the fourth side; and a fourth tapered side corresponding to the second tapered side and connected to a second end of the fifth side, the fourth tapered side positioned opposite the third tapered side; and wherein the depth positioning portion is received in a form-fit manner in the receiving portion of the frame such that (i) the first side abuts the fourth side, (ii) the second side abuts the fifth side, (iii) the third side abuts the sixth side, (iv) the first tapered side abuts the third tapered side, and (v) the second tapered side abuts the fourth tapered side to fix the hinge plate to the frame in a depth direction of the dishwasher cavity.

2. The dishwasher cavity of claim 1, wherein the hinge plate has a height positioning portion configured to fix the hinge plate to the frame in a height direction of the dishwasher cavity.

3. The dishwasher cavity of claim 2, wherein the frame has a contact portion, on which the height positioning portion rests so as to fix the hinge plate in the height direction.

4. The dishwasher cavity of claim 1, further comprising a door mounted pivotably on the hinge plate.

5. The dishwasher cavity of claim 1, wherein the frame comprises a first limb, which is connected to a first side wall of the dishwasher cavity casing, and a second limb, which is connected to a second side wall of the dishwasher cavity casing, and further comprising a further hinge plate, with one of the hinge plates being provided on one of the first and second limbs, and with the other one of the hinge plates being provided on the other one of the first and second limbs.

6. The dishwasher cavity of claim 1, further comprising a bottom panel, on which the dishwasher cavity casing is arranged and with which the dishwasher cavity casing is fixedly connected, and a rear wall, which is fixedly connected to the dishwasher cavity casing and the bottom panel, and which closes the dishwasher cavity in the depth direction on a rear side.

7. A household dishwasher comprising a dishwasher cavity, the dishwasher cavity comprising:

a U-shaped household dishwasher casing; and a U-shaped frame connected to the household dishwasher casing and supporting the household dishwasher casing, the frame comprising:

a receiving portion that comprises:

a first side;

a second side positioned opposite the first side;

a third side connecting a first end of the first side to a first end of the second side; and a first introducer sheath configured to introduce a depth positioning portion into the receiving portion, the first introducer sheath comprising:

a first tapered side connected to a second end of the first side; and a second tapered side opposite the first tapered side and connected to a second end of the second side; and a hinge plate including the depth positioning portion that comprises:

a fourth side corresponding to the first side;

a fifth side corresponding to the second side and positioned opposite the fourth side;

a sixth side corresponding to the third side and connecting a first end of the fourth side to a first end of the fifth side; and a second introducer sheath corresponding to the first introducer sheath, the second introducer sheath comprising:

a third tapered side corresponding to the first tapered side and connected to a second end of the fourth side; and a fourth tapered side corresponding to the second tapered side and connected to a second end of the fifth side, the fourth tapered side positioned opposite the third tapered side; and wherein the depth positioning portion is received in a form-fit manner in the receiving portion of the frame such that (i) the first side abuts the fourth side, (ii) the second side abuts the fifth side, (iii) the third side abuts the sixth side, (iv) the first tapered side abuts the third tapered side, and (v) the second tapered side abuts the fourth tapered side to fix the hinge plate to the frame in a depth direction of the household dishwasher.

8. The household dishwasher of claim 7, wherein the hinge plate has a height positioning portion configured to fix the hinge plate to the frame in a height direction of the household dishwasher.

9. The household dishwasher of claim 8, wherein the frame has a contact portion, on which the height positioning portion rests so as to fix the hinge plate in the height direction.

10. The household dishwasher of claim 7, wherein the dishwasher cavity includes a door mounted pivotably on the hinge plate.

11. The household dishwasher of claim 7, wherein the frame comprises a first limb, which is connected to a first side wall of the household dishwasher casing, and a second limb, which is connected to a second side wall of the household dishwasher casing, said dishwasher cavity comprising a further hinge plate, with one of the hinge plates being provided on one of the first and second limbs, and with the other one of the hinge plates being provided on the other one of the first and second limbs.

12. The household dishwasher of claim 7, wherein the dishwasher cavity includes a bottom panel, on which the household dishwasher casing is arranged and with which the household dishwasher casing is fixedly connected, and a rear wall, which is fixedly connected to the household dishwasher casing and the bottom panel, and which closes the household dishwasher in the depth direction on a rear side.

* * * * *